US006481346B1

(12) United States Patent
Miller

(10) Patent No.: US 6,481,346 B1
(45) Date of Patent: Nov. 19, 2002

(54) COMPACTOR

(76) Inventor: Michael S. Miller, 1805 Haddington Dr., Durham, NC (US) 27712

( * ) Notice: Subject to any disclaimer, the term of this patent is extended or adjusted under 35 U.S.C. 154(b) by 216 days.

(21) Appl. No.: 09/605,073

(22) Filed: Jun. 28, 2000

(51) Int. Cl.[7] ..... B30B 9/32
(52) U.S. Cl. ..... 100/269.13; 100/289; 100/902
(58) Field of Search ..... 100/269.13, 289, 100/902

(56) References Cited

U.S. PATENT DOCUMENTS

| | | | | | |
|---|---|---|---|---|---|
| 3,934,498 | A | * | 1/1976 | Hochanadel | 100/238 |
| 4,168,661 | A | * | 9/1979 | Wigdahl | 100/218 |
| 4,208,960 | A | | 6/1980 | Leitgeb | 100/35 |
| 4,228,734 | A | * | 10/1980 | Parrish | 100/245 |
| 4,301,722 | A | | 11/1981 | Balbo et al. | 100/218 |
| 4,345,519 | A | | 8/1982 | Sabino | 100/215 |
| 4,597,327 | A | | 7/1986 | Gardner | 100/295 |
| 4,700,950 | A | * | 10/1987 | Gardner | 100/902 |
| 5,174,199 | A | | 12/1992 | King et al. | 100/48 |
| 5,361,690 | A | * | 11/1994 | Hsu | 100/125 |
| 5,584,239 | A | * | 12/1996 | Yelczyn et al. | 100/293 |
| 5,829,348 | A | * | 11/1998 | Morgan | 100/131 |
| 5,839,350 | A | | 11/1998 | Mefferd et al. | 92/152 |
| 5,899,141 | A | * | 5/1999 | Gross et al. | 100/125 |

* cited by examiner

*Primary Examiner*—William Hong
(74) *Attorney, Agent, or Firm*—Olive & Olive, P.A.

(57) ABSTRACT

The present invention provides an effective compactor apparatus and method for crushing empty recyclable containers. The compactor has a housing for containing the container to be crushed with a plunger that is able to be moved downwardly and rotated within the housing. The combined downward and rotational movement serves to achieve a maximally compressed container. The compressed container is ejected from the housing by further extension of the plunger.

4 Claims, 2 Drawing Sheets

COMPACTOR

FIELD OF THE INVENTION

The present invention relates to the field of compactors for crushing recyclable containers, and more particularly to such compactors that are manually actuated.

BACKGROUND OF THE INVENTION

Recycling conserves resources and also conserves space, particularly landfill space. Containers for liquids are primary examples of items for which recycling is logical. A container, when empty, takes up space without performing a function. By keeping a container from a landfill, the useful life of the landfill is extended and surrounding land does not have to be acquired for this purpose. By recycling a container, the material of which it is made can be used again, rather than making more of the same material from a diminishing supply of natural resources.

However, containers, in their full size, require space to store and vehicle space to transport. Thus, reducing the volume by crushing minimizes the space requirement to a more manageable amount. Even for non-recylcable containers, reduction of size is beneficial to reduce the space needed for garbage handling and in landfills.

Numerous devices have been developed for the purpose of crushing containers for recycling. Some examples are as follows:

U.S. Pat. No. 4,345,519 to Sabino describes a Vertical Can Crusher. This patent involves placing a recyclable container into a receptacle and forcing a ram down onto the container by means of a lever handle. To remove the crushed container from the device, the receptacle is moved out of its crushing position and the crushed can is pushed out of the receptacle.

U.S. Pat. No. Des. 266,566 issued to Schmid for an Aluminum Can Cruncher. This design patent depicts a device having a ram that is positioned over an anvil and a lever arm for actuating the ram. The ram has a disk attached to its lower end that is formed with a rim in a lower surface thereof that is intended to engage the upper rim of a can being crushed.

SUMMARY OF THE INVENTION

The invention involves a method and apparatus having a housing and a plunger and the apparatus being adapted for compacting empty containers, particularly large soft drink containers. The housing is formed having a circular cylindrical bottom portion, a conical transition portion, and a circular cylindrical top portion. The bottom portion is larger in diameter than the top portion. The bottom end of the bottom portion cylinder is open. The plunger has a shaft extending between a conical shoe on its bottom and a handle on its top. The shaft fits slidingly into the top portion of the housing with the handle above and the shoe within the cylinder. The apparatus is placed for use with the housing surrounding a container to be compacted, and with the shoe resting on the upper end of the container. The user presses down while rotating the handle so that the container is compressed and twisted simultaneously, minimizing the space it ultimately occupies. The apparatus is lifted and the handle pushed farther to discharge the compressed container. The compactor is sized to compress containers from a 12 ounce soft drink can to large bottles of up to three liters in capacity.

BRIEF DESCRIPTION OF THE DRAWINGS

In order for the invention to become more clearly understood it will be disclosed in greater detail with reference to the accompanying drawings, in which.

DESCRIPTION OF THE PREFERRED EMBODIMENT

Figure 1:
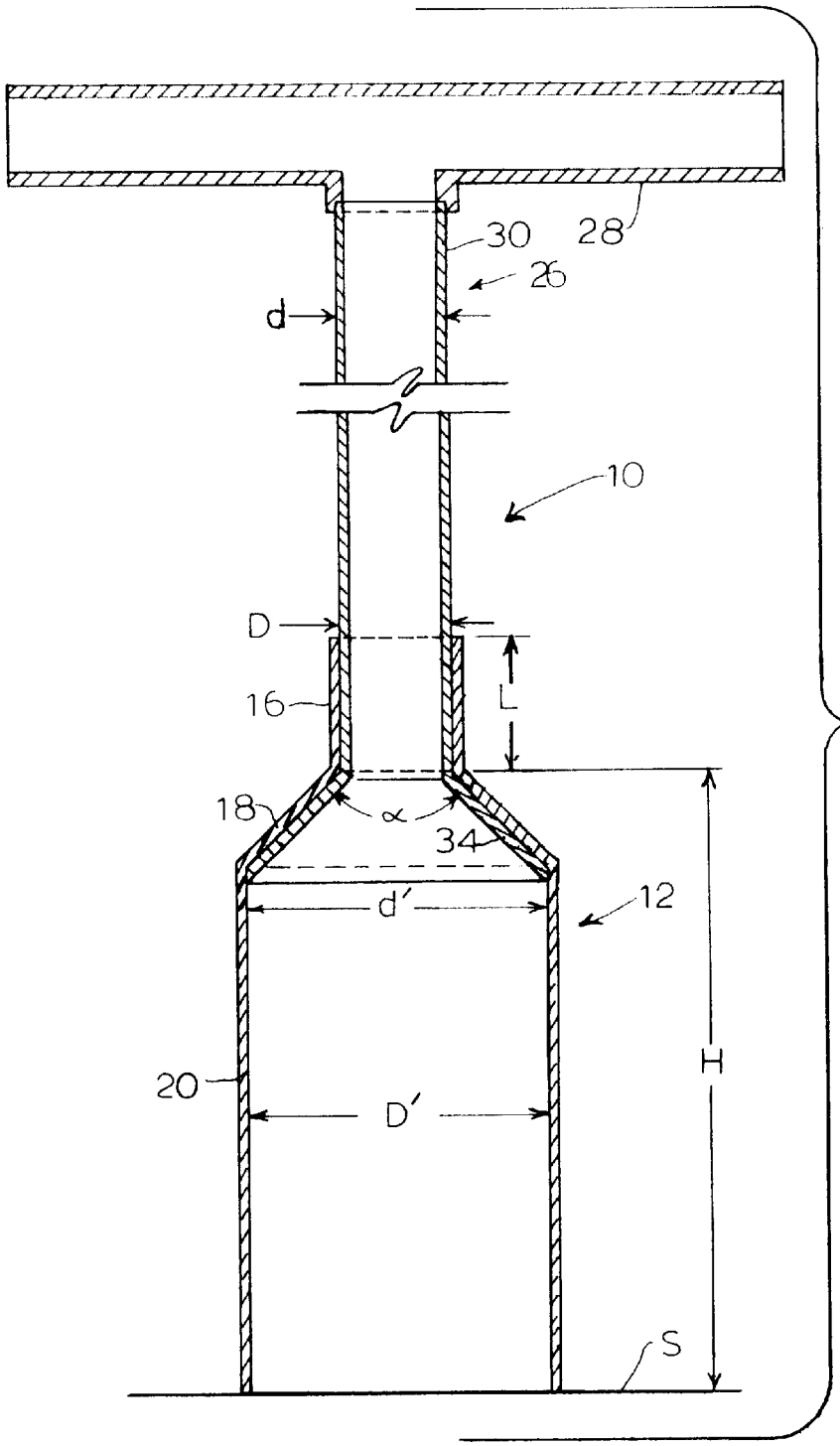
FIG. 1 is a cross sectional view of the compactor of the present invention.

Referring to FIG. 1, compactor 10 comprises a combination of two main components, housing 12 and plunger 26. Housing 12 includes neck portion 16 which is substantially tubular with an internal bore, transition portion 18 which is substantially conical with its narrow, upper end contiguous with the bottom of neck portion 16, and body portion 20 which is substantially cylindrical, with its upper end contiguous with the wide, lower end of transition portion 18. Each of the portions making up housing 12 is circular in any cross section in a horizontal plane. The bottom end of body portion 20 is open in the preferred embodiment and rests on supporting surface S when compactor 10 is being used to crush a container. Neck portion 16, transition portion 18, and body portion 20 are all substantially coaxial.

Continuing with FIG. 1, plunger 26 comprises shoe 34 which is substantially conical with an open bottom, shaft 30 which is substantially tubular, the lower end of which is contiguous with the narrow top of shoe 34, and handle 28 which is connected to the upper end of shaft 30. Shoe 34 is formed, in the preferred embodiment, with included angle of about 90°. Handle 28 is of any convenient cross sectional shape, and is circularly tubular in the preferred embodiment. Shaft 30 and shoe 34 are substantially coaxial. The conical internal configuration of shoe 34 is adapted for firmly engaging the top of the cylindrical wall of container C. The invention further recognizes that other shapes for shoe 34, e.g., partial-spherical, pyramidal, etc. could be used.

The inside diameter D of neck portion 16 is slightly greater than the outside diameter d of shaft 30 so that shaft 30 slides and rotates freely within neck portion 16. The length L of neck portion 16 is sufficiently long to keep shaft 30 substantially coaxial with housing 20. The inside diameter D' of body portion 20 is slightly greater than the outside diameter d' of shoe 34 so that shoe 34 will not bind when plunger 26 is moved vertically or rotated with respect to housing 12.

The height H, representing the distance from the juncture between shoe 34 and shaft 30 and supporting surface S when plunger 26 is fully raised, is sufficient to accommodate a recyclable beverage container, e.g., a two liter soft drink bottle, when within housing 12.

The above described components comprising compactor 10 are, in the preferred embodiment, formed of substantially rigid plastics resin such as polyvinyl chloride. The components described may be formed by the process of injection molding, although it is recognized that handle 28 will preferably be assembled subsequent to shaft 30 being inserted through neck 16 of housing 12.

Figure 2:
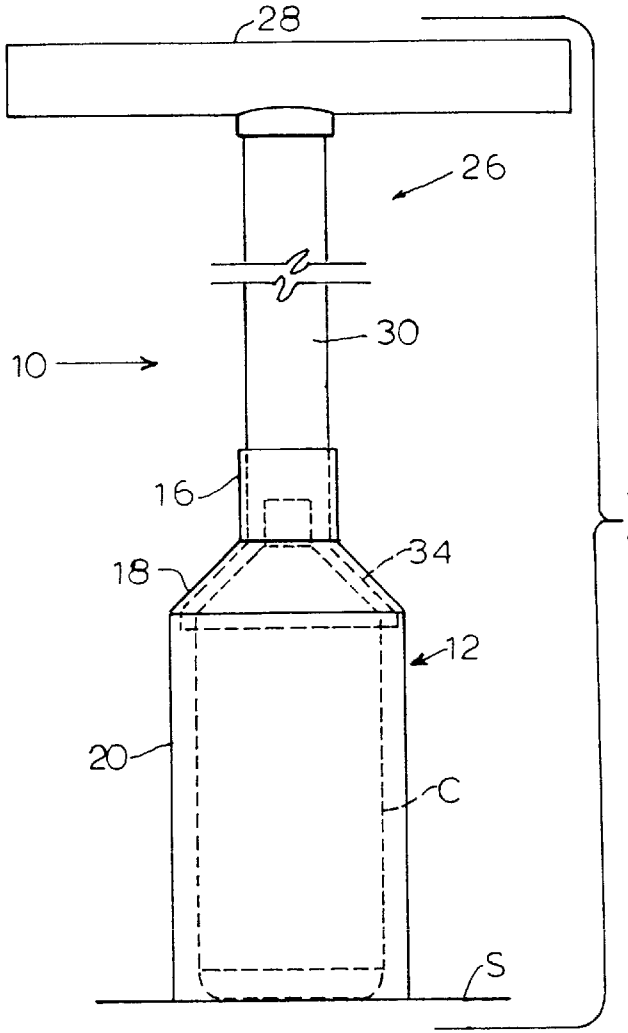
FIG. 2 is front elevation view of the compactor of FIG. 1 with a plastic beverage container positioned within for being crushed.

Referring now to FIG. 2, compactor 10 is illustrated in front elevation view with an empty beverage container C positioned standing coaxially therewithin. Container C portrayed in FIG. 2 is, for example, a three liter soft drink plastic bottle. For reasons of drawing clarity, internal wall lines are omitted. As housing 12 rests on surface S, the upper part of container C is enclosed within shoe 34 of plunger 26. Plunger 26 is in its uppermost position.

Figure 3:
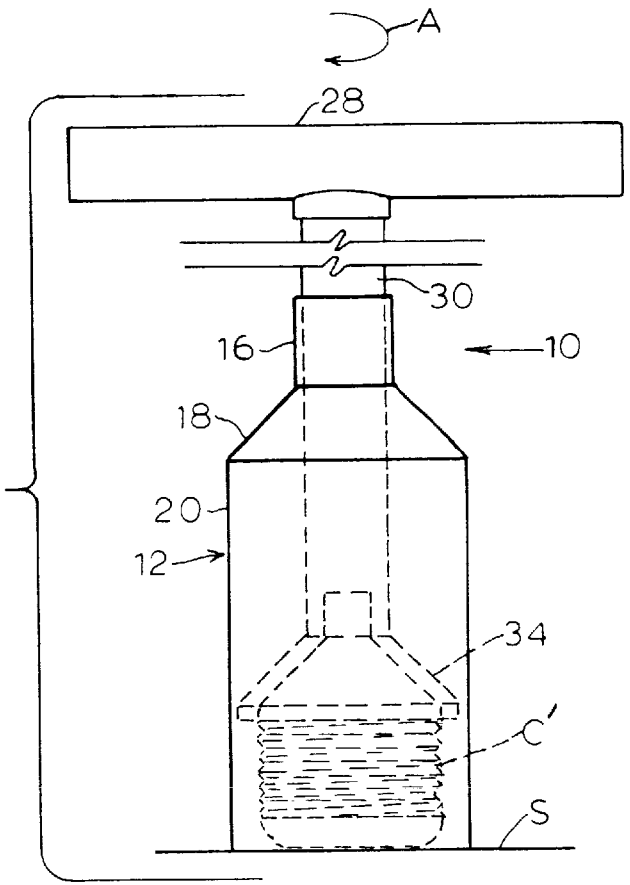
FIG. 3 is the view of FIG. 2 after the plastic container has been crushed.

To compress container C, the user presses downwardly on handle 28, causing shoe 34 of plunger 26 to move down into housing 12. As the user presses down on handle 28, the user also causes handle 28 to rotate, for example in the direction of arrow A (seen in FIG. 3), so as to cause container C to collapse. By applying a rotating motion as plunger 26 is pressed down, the pattern of collapse of container C enables a more effective and complete compression than can be obtained with a straight downward push. In the case of larger diameter containers, crushed container C' will generally push against the inner wall of body portion 20. The user then lifts compactor 10 off surface S to remove crushed container C' therefrom. If crushed container C' is stuck in body portion 20, the user presses plunger 26 farther to eject compressed container C' out of housing 12. Shaft 30 is long enough to push shoe 34 to the end of body portion 20. The resultant crushed container C' can then be stored in substantially less space than a non-compressed container.

Compactor 10 may also be utilized to crush smaller containers, including 12-ounce beverage cans. A smaller container would be positioned within body portion 20 and beneath shoe 34. Because smaller containers are typically smaller in diameter as well as height, such smaller containers must be positioned near the center of housing 20 so that conical shoe 34 will uniformly contact the top surface of the container being crushed.

The above detailed description of a preferred embodiment of the invention sets forth the best mode contemplated by the inventor for carrying out the invention at the time of filing this application and is provided by way of example and not as a limitation. Accordingly, various modifications and variations which may be obvious to a person of ordinary skill in the art to which it pertains are deemed to lie within the scope and spirit of the invention as set forth in the following claims.

What is claimed is:

1. A compactor for crushing a plastic beverage container of the type having a tapered upper portion, comprising:

(c) a housing having a bore at an upper end thereof, an open lower end and an interior volume sufficient to enclose a plastic beverage container of the described type; and (d) a plunger with a shaft configured and assembled to slide axially within the bore and having a handle at an upper end thereof and a shoe at a lower end thereof, said shoe having an open internal configuration that generally matches the taper at the upper portion of a plastic container of the described type.

2. The compactor as claimed in claim 1, wherein the shoe has a generally conical configuration that is open at its bottom.

3. The compactor as claimed in claim 2 wherein the included angle of the conical shoe is on the order of 90°.

4. A compactor for crushing an empty container, comprising:

(a) a housing having a bore at an upper end thereof and an open lower end; and (b) a plunger with a shaft configured to slide axially within the bore and having a shoe at a lower end thereof and a handle affixed at an upper end thereof wherein the shoe is substantially conical with an open bottom.

* * * * *